US008701770B2

(12) United States Patent
Schultz et al.

(10) Patent No.: US 8,701,770 B2
(45) Date of Patent: Apr. 22, 2014

(54) HEATED FLUID INJECTION USING MULTILATERAL WELLS

(75) Inventors: Roger L. Schultz, Aubrey, TX (US); Travis W. Cavender, Angleton, TX (US); Steven Ronald Fipke, Humble, TX (US); Aditya Shailesh Deshmukh, Bangalore (IN); David J. Steele, Arlington, TX (US); Jorge Enrique Velez, Bogota (CO); Eulalio Rosas Fermin, Maturin (VE)

(73) Assignee: Halliburton Energy Services, Inc., Houston, TX (US)

( * ) Notice: Subject to any disclaimer, the term of this patent is extended or adjusted under 35 U.S.C. 154(b) by 565 days.

(21) Appl. No.: 12/667,989

(22) PCT Filed: Jul. 3, 2008

(86) PCT No.: PCT/US2008/069249

§ 371 (c)(1),
(2), (4) Date: Nov. 3, 2010

(87) PCT Pub. No.: WO2009/009445

PCT Pub. Date: Jan. 15, 2009

(65) Prior Publication Data

US 2011/0036576 A1 Feb. 17, 2011

Related U.S. Application Data

(60) Provisional application No. 60/948,346, filed on Jul. 6, 2007.

(51) Int. Cl.
*E21B 43/24* (2006.01)
*E03B 3/11* (2006.01)

(52) U.S. Cl.
USPC ..... 166/303; 166/50; 166/272.7

(58) Field of Classification Search
USPC ..... 166/117.5, 303, 302, 50, 245, 242.3, 166/117.6, 250.06, 272.1, 272.3, 272.7; 175/61, 62
See application file for complete search history.

(56) References Cited

U.S. PATENT DOCUMENTS 3,946,809 A 3/1976 Hagedorn
3,994,340 A * 11/1976 Anderson et al. ..... 166/272.3

(Continued)

FOREIGN PATENT DOCUMENTS

EP 0 900 911 3/1999
GB 2 031 975 4/1980

(Continued)

OTHER PUBLICATIONS

K.C. Hong, "Recent Advances in Steamflood Technology," SPE 54078, Copyright 1999, Society of Petroleum Engineers, Inc., 14 pages.

(Continued)

*Primary Examiner* — Kenneth L Thompson
(74) *Attorney, Agent, or Firm* — Scott F. Wendorf; Fish & Richardson P.C.

(57) ABSTRACT

A well system includes a main wellbore extending from a terranean surface toward a subterranean zone. A first lateral wellbore extends from the main wellbore into the subterranean zone. A second lateral wellbore extends from the main wellbore into the subterranean zone. A liner junction device resides in the main wellbore and has a first leg extending into the first lateral wellbore and a second leg extending downhole in the main wellbore. A treatment fluid injection string extends from in the main wellbore through the liner junction and into the first lateral wellbore and terminates in the first lateral wellbore. A seal in the first lateral wellbore seals against flow toward the main wellbore in an annulus adjacent an outer surface of the treatment fluid injection string.

31 Claims, 4 Drawing Sheets

(56) References Cited

U.S. PATENT DOCUMENTS

| | | | | |
|---|---|---|---|---|
| 4,020,901 | A | 5/1977 | Pisio et al. | |
| 4,022,280 | A | 5/1977 | Stoddard et al. | |
| 4,129,308 | A | 12/1978 | Hutchison | |
| 4,160,481 | A * | 7/1979 | Turk et al. | 166/272.3 |
| 4,380,265 | A | 4/1983 | Mohaupt | |
| 4,460,044 | A | 7/1984 | Porter | |
| 4,834,174 | A | 5/1989 | Vandevier | |
| 4,982,786 | A | 1/1991 | Jennings, Jr. | |
| 5,040,605 | A | 8/1991 | Showalter | |
| 5,052,482 | A | 10/1991 | Gondouin | |
| 5,054,551 | A | 10/1991 | Duerksen | |
| 5,085,275 | A | 2/1992 | Gondouin | |
| 5,123,485 | A | 6/1992 | Vasicek et al. | |
| 5,289,881 | A | 3/1994 | Schuh | |
| 5,297,627 | A | 3/1994 | Sanchez et al. | |
| 5,520,252 | A | 5/1996 | McNair | |
| 5,526,880 | A * | 6/1996 | Jordan et al. | 166/291 |
| 5,803,178 | A | 9/1998 | Cain | |
| 5,915,474 | A * | 6/1999 | Buytaert et al. | 166/50 |
| 5,941,308 | A * | 8/1999 | Malone et al. | 166/313 |
| 6,079,494 | A | 6/2000 | Longbottom et al. | |
| 6,158,513 | A | 12/2000 | Nistor et al. | |
| 6,311,776 | B1 * | 11/2001 | Pringle et al. | 166/313 |
| 6,679,326 | B2 * | 1/2004 | Zakiewicz | 166/272.5 |
| 8,256,517 | B2 * | 9/2012 | Ingraham et al. | 166/313 |
| 2002/0112857 | A1 | 8/2002 | Ohmer et al. | |
| 2003/0102124 | A1 | 6/2003 | Vinegar et al. | |
| 2003/0111223 | A1 | 6/2003 | Rouffignac et al. | |
| 2003/0116315 | A1 | 6/2003 | Wellington et al. | |
| 2003/0131993 | A1 | 7/2003 | Zhang et al. | |
| 2003/0131994 | A1 | 7/2003 | Vinegar et al. | |
| 2003/0141066 | A1 | 7/2003 | Karanikas et al. | |
| 2003/0141067 | A1 | 7/2003 | Rouffignac et al. | |
| 2003/0141068 | A1 | 7/2003 | Pierre de Rouffignac et al. | |
| 2003/0164239 | A1 | 9/2003 | Wellington et al. | |
| 2003/0209348 | A1 | 11/2003 | Ward et al. | |
| 2003/0221843 | A1 | 12/2003 | Fipke et al. | |
| 2004/0035581 | A1 * | 2/2004 | Cavender | 166/313 |
| 2004/0055750 | A1 | 3/2004 | Restarick et al. | |
| 2004/0177966 | A1 | 9/2004 | Vinegar et al. | |
| 2005/0103497 | A1 * | 5/2005 | Gondouin | 166/302 |
| 2006/0175061 | A1 * | 8/2006 | Crichlow | 166/302 |

FOREIGN PATENT DOCUMENTS

| | | |
|---|---|---|
| GB | 2 241 008 | 8/1991 |
| GB | 2 340 152 | 2/2000 |
| GB | 2 408 761 | 6/2005 |
| SU | 1114782 | 9/1984 |
| WO | WO 93/23134 | 11/1993 |
| WO | WO 98/40603 | 9/1998 |
| WO | WO 99/30002 | 6/1999 |
| WO | WO 00/25002 | 5/2000 |
| WO | WO 03/038233 A1 | 5/2003 |
| WO | WO 2005/012688 A1 | 2/2005 |

OTHER PUBLICATIONS

Gary R. Greaser and J. Raul Ortiz, "New Thermal Recovery Technology and Technology Transfer for Successful Heavy Oil Development," SPE 69731, Copyright 2003, Society of Petroleum Engineers, Inc., 7 pages.

A.J. Mulac, J.A. Beyeloer, R.G. Clay, K.R. Darnall, A.B. Donaldson, T.D. Donham, R.L. Fox, D.R. Johnson and R.L. Maxwell, "Project Deep Steam Preliminary Field Test Bakersfield, California," SAND80-2843, Printed Apr. 1981, 62 pages.

NTIS, Downhole Steam-Generator Study. vol. 1, Conception and Feasibility Evaluation. Final Report, Sep. 1978-Sep. 1980, Sandia National Labs, Albuquerque NM, Jun. 1982. 260 pages.

Presentation by Daulat D. Mamora, "Thermal Oil Recovery Research at Texas A&M in the Past Five Years—an Overview," Crisman Institute Halliburton Center for Unconventional Resources, Research Meeting Aug. 3, 2006, Department of Petroleum Engineering, Texas A&M University (13 pages).

Presentation by Jose A. Rivero, "An Experimental Study of Steam and Steam-Propane Injection Using a Novel Smart Horizontal Producer to Enhance Oil Production in the San Ardo Field." Sponsor's Meeting, Crisman Institute, Aug. 3, 2006, Department of Petroleum Engineering, Texas A&M University, 7 pages.

Examination Report for European Patent Application No. 08781189.9 dated Jun. 1, 2010, 4 pages.

Examination Report for European Patent Application No. 08781397.8 dated Sep. 6, 2010, 4 pages.

Examination Report for European Patent Application No. 08781397.8 dated Jan. 19, 2011, 4 pages.

Office Action dated Jul. 18, 2011 for corresponding Canadian Patent Application No. 2,692,678 (2 pages).

Notification of Transmittal of the International Search Report and the Written Opinion of the International Searching Authority, or Declaration (3 pages); International Search Report (4 pages); and Written Opinion of the International Searching Authority (6 pages), mailed Nov. 3, 2010, for related international application PCT/US2008/069249.

Notification Concerning Transmittal of International Preliminary Report on Patentability (7 pages) mailed Mar. 25, 2010, for related international application PCT/US2008/069249.

Office Action dated Mar. 2, 2011 for corresponding Russian Patent Application No. 2010102672 (2 pages).

Office Action dated Jun. 18, 2012 for corresponding Chinese Patent Application No. 2000880105862.3 (10 pages).

Office Action mailed Mar. 7, 2013 in corresponding Chinese application No. 200880105862.3 with translation (18 pages).

* cited by examiner

HEATED FLUID INJECTION USING MULTILATERAL WELLS

REFERENCE TO RELATED APPLICATIONS

This application is a National Stage application of, and claims the benefit of priority to, PCT/US2008/069249, filed Jul. 3, 2008, which claims the benefit of priority to U.S. Provisional Patent Application No. 60/948,346 filed Jul. 6, 2007, the entirety of both are incorporated by reference herein.

TECHNICAL FIELD

This present disclosure relates to resource production, and more particularly to resource production using heated fluid injection into a subterranean zone.

BACKGROUND

Fluids in hydrocarbon formations may be accessed via wellbores that extend down into the ground toward the targeted formations. In some cases, fluids in the hydrocarbon formations may have a low enough viscosity that crude oil flows from the formation, through production tubing, and toward the production equipment at the ground surface. Some hydrocarbon formations comprise fluids having a higher viscosity, which may not freely flow from the formation and through the production tubing. These high viscosity fluids in the hydrocarbon formations are occasionally referred to as "heavy oil deposits." In the past, the high viscosity fluids in the hydrocarbon formations remained untapped due to an inability to economically recover them. More recently, as the demand for crude oil has increased, commercial operations have expanded to the recovery of such heavy oil deposits.

In some circumstances, the application of heated treatment fluids to the hydrocarbon formation may reduce the viscosity of the fluids in the formation so as to permit the extraction of crude oil and other liquids from the formation. The design of systems to deliver the steam to the hydrocarbon formations may be affected by a number of factors.

SUMMARY

In certain aspects, a well system includes a main wellbore extending from a terranean surface toward a subterranean zone. A first lateral wellbore extends from the main wellbore into the subterranean zone. A second lateral wellbore extends from the main wellbore into the subterranean zone. A liner junction device resides in the main wellbore and has a first leg extending into the first lateral wellbore and a second leg extending downhole in the main wellbore. A treatment fluid injection string extends from in the main wellbore through the liner junction and into the first lateral wellbore and terminates in the first lateral wellbore. A seal in the first lateral wellbore seals against flow toward the main wellbore in an annulus adjacent an outer surface of the treatment fluid injection string.

In certain aspects, a well system includes a multilateral wellbore system having a main wellbore and a plurality of lateral wellbores extending from the main wellbore. A liner junction device resides in the main wellbore. A liner resides in one of the lateral wellbores and coupled to the liner junction device. A heated fluid injection string extends from in the main wellbore, through the liner junction device, and terminates in the liner. Seals seal against flow to the main wellbore from between the liner and the lateral wellbore and from between the heated fluid injection string and the liner.

In certain aspects, a method includes injecting a treatment fluid into an lateral injection wellbore extending from a main wellbore with the treatment fluid injection string terminating in the lateral injection wellbore. An annulus adjacent an outer surface of the treatment fluid injection string is sealed against flow toward the main wellbore. Fluid is produced from a production lateral wellbore that extends from the main wellbore and is spaced apart from the lateral injection wellbore.

Certain aspects can include one or more of the following features. The well system can a downhole fluid heater in the treatment fluid injection string. The downhole fluid heater can be disposed in the first lateral wellbore. The seal can seal between the downhole fluid heater and the first leg of the liner junction device. The seal can include a polished bore receptacle. The treatment fluid injection string can be coupled to a source of heated treatment fluid at the terranean surface. The seal can seal between the treatment fluid injection string and the first leg of the liner junction device. A second seal can be provided in the first lateral wellbore that seals against flow toward the main wellbore in an annulus adjacent the second leg and the first lateral wellbore. The second seal can include a deposit of cement. A seal in the main bore can be included that seals against axial flow in an annulus adjacent an outer surface of the liner junction device.

Systems and methods based on multilateral steam assisted gravity drainage can reduce upper well requirements and provide substantial drilling and completion cost savings. Similarly, reduced surface facility requirements can provide cost savings and reduce environmental impacts because of the reduced surface footprint of the well system.

Innovative placement of sealing assemblies can allow for concentric tubes to inject steam down an inner tube and produce oil up an annulus between the tubes, while still maintaining pressure integrity of multilateral junction at bottom hole temperatures.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
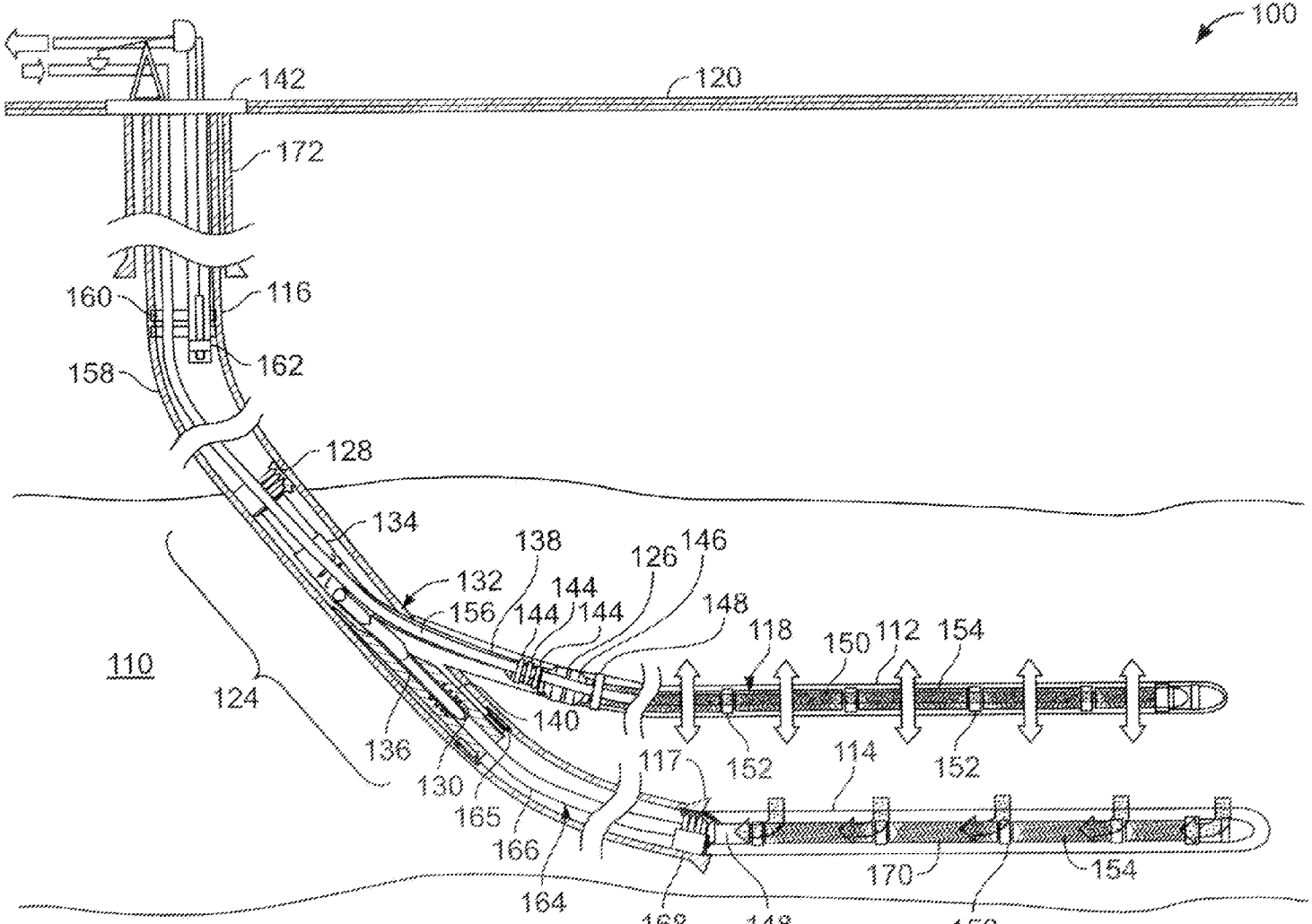
FIG. 1 is a schematic view of an embodiment of a system for treating a subterranean zone.

Systems and methods of treating a subterranean zone can include a multilateral well having one or more lateral wellbores drilled in a formation containing reservoirs of high viscosity fluids. The lateral wellbores can be used to access one or more subterranean zones of interest. In a steam assisted gravity drainage (SAGD) configuration, an upper wellbore can be used to inject heated treatment fluids and a lower wellbore can be used to produce fluids from the zone. In other configurations, such as a cyclic injection configuration (a.k.a.

huff-n-puff), one or more lateral wellbores can be used for both injecting heated treatment fluid and to produce fluid from the formation. The injected heated treatment fluid can lower the viscosity of formation fluids which allows them to flow down into the lower wellbore. Some examples of treatment fluid include steam, liquid water, diesel oil, gas oil, molten sodium, and/or synthetic heat transfer fluids. Example synthetic heat transfer fluids include THERMINOL 59 heat transfer fluid which is commercially available from Solutia, Inc., MARLOTHERM heat transfer fluid which is commercially available from Condea Vista Co., SYLTHERM and DOWTHERM heat transfer fluids which are commercially available from The Dow Chemical Company, and others.

In some cases, the upper or injection wellbore and the lower or production wellbore extend into the subterranean zone from a single main bore extending from a terranean surface toward the subterranean zone. A liner junction in the main bore can have a lateral injection leg extending into the lateral injection bore and a second leg extending downhole in the main wellbore. A treatment fluid injection string can extend from the main bore through the liner junction and into the lateral injection bore and terminate in the lateral injection bore. A seal in the lateral injection bore seals against flow toward the junction in an annulus adjacent an outer surface of the treatment fluid injection string. When discussing a seal sealing a flow passage, the sealing can be a complete seal (e.g., prevents flow of gas and liquid) or a partial or imperfect seal (e.g., limits or reduces but does not prevent all flow).

In some cases, a downhole fluid heater that heats a treatment fluid downhole can be installed in lateral wellbores extending from a main wellbore. The heated fluid generator can heat the treatment fluid to a heated liquid or into vapor of 100% quality or less. In certain instances, the heated fluid generator is a downhole steam generator. Some examples of heated fluid generators (down hole or surface based) that can be used in accordance with the concepts described herein include electric type heated fluid generators (see, e.g., U.S. Pat. Nos. 5,623,576, 4,783,585, and/or others), combustor type heated fluid generators (see, e.g., Downhole Steam Generation Study Volume I, SAND82-7008, and/or others), catalytic type steam generators (see, e.g., U.S. Pat. Nos. 4,687,491, 4,950,454, U.S. Pat. Pub. Nos. 2006/0042794 2005/0239661 and/or others), and/or other types of heated fluid generators (see, e.g., Downhole Steam Generation Study Volume I, SAND82-7008, discloses several different types of steam generators). Supplying heated treatment fluid from the downhole fluid heater(s) to a target subterranean zone, such as one or more hydrocarbon-bearing formations or a portion or portions thereof, can reduce the viscosity of oil and/or other fluids in the target subterranean zone. In some instances, downhole fluid heater systems include automatic control valves in the proximity of the downhole fluid heater for controlling the flow rate of water, fuel and oxidant to the downhole fluid heater. These systems can be configured such that loss of surface, wellbore or supply pressure integrity will cause closure of the downhole safety valves and rapidly discontinue the flow of fuel, water, and/or oxidant to the downhole fluid heater to provide failsafe downhole combustion or other power release.

Figure 2:
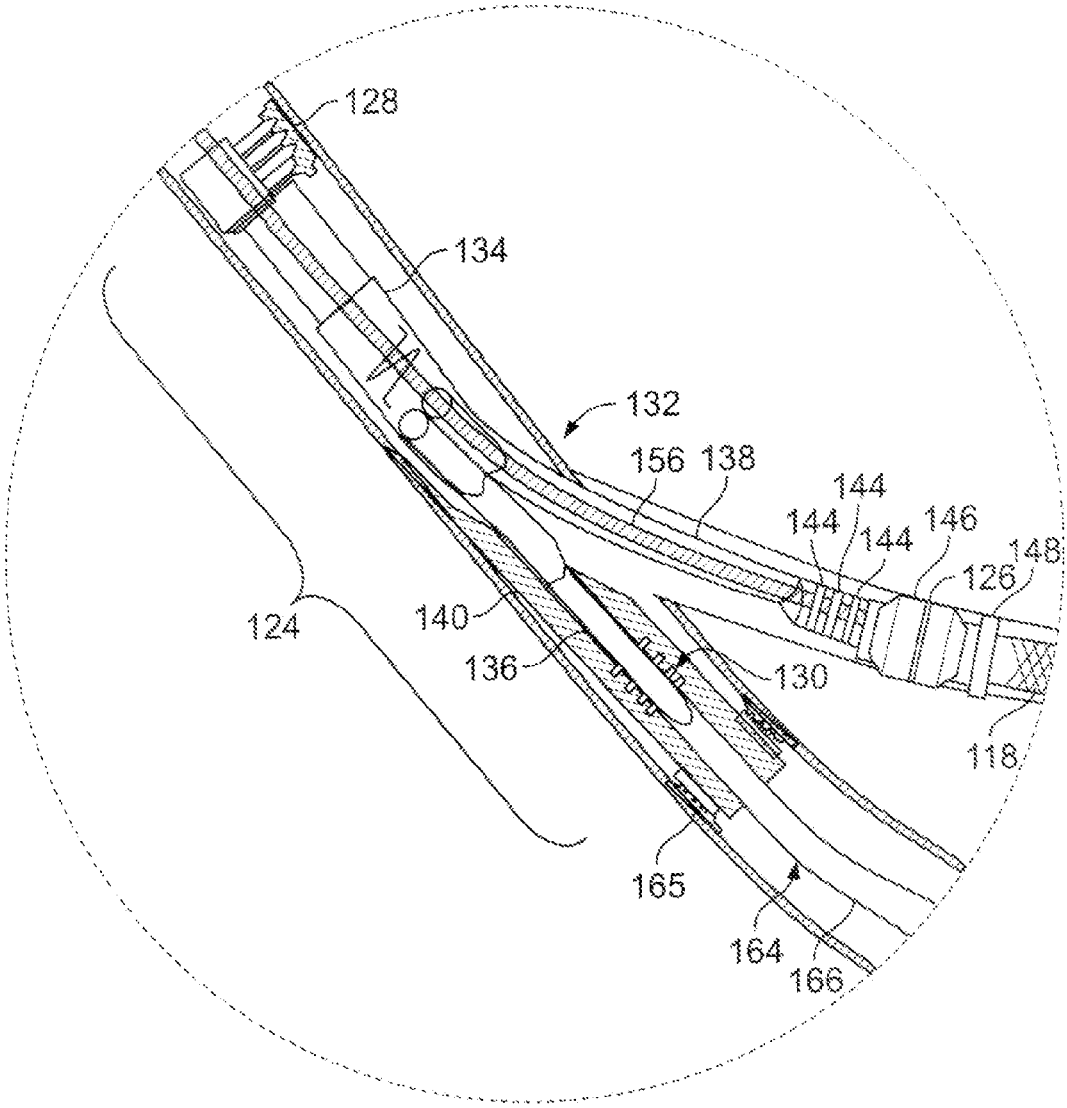
FIG. 2 is an enlarged schematic view of a portion of the system of FIG. 1.

Referring to FIGS. 1 and 2, a system 100 for treating a subterranean zone 110 includes a first lateral injection wellbore 112 and a second lateral wellbore 114 extending from a primary or main wellbore 116 into the subterranean zone 110. As illustrated, the first lateral wellbore 112 is an injection wellbore through which treatment fluids are injected and the second lateral wellbore 114 is a production wellbore through which recovered reservoir fluids are produced. The main wellbore 116 extends from the terranean surface 120 to a casing footer 117 in or near the subterranean zone 110 with the production lateral wellbore 114 extending from the end of the main wellbore 116 and the lateral injection wellbore 112 kicking-off of the main wellbore 116 uphole of the production lateral wellbore 114. Fewer or more lateral wellbores can be provided extending from the main wellbore. In FIG. 1, the main wellbore 116 is shown deviating from vertical to be a slanted wellbore. In certain instances, the main wellbore 116 can be entirely, substantially vertical. Additionally, the production lateral wellbore 114 is shown extending from the end of the main wellbore 116; however, the lateral wellbore 114 can kick-off from another location along the main wellbore 116. In some cases, the main wellbore 116 may have a sump extending below the lateral wellbore 114.

An injection lateral liner 118 is disposed in the lateral injection wellbore 112. The injection lateral liner 118 is adapted to communicate injection fluids into the subterranean zone 110. In this embodiment, the injection lateral liner 118 extends from a liner junction device 124, and into lateral injection wellbore 112.

The liner junction device 124 is installed at the junction 132 between the lateral injection wellbore 112 and the main wellbore 116. The illustrated liner junction device 124 includes a body 134 that extends from an upper seal assembly 128 disposed in the main wellbore 116 uphole of the junction 132 to first and second legs 136, 138. Some examples of upper seal assembly 128 include a packer, a packer liner hanger that engages the casing 158 of the main wellbore 116 (e.g., by slips, a profile and/or otherwise) to support the liner junction device 124 and/or other seal assembly. The second leg 136 extends from the body 134 of the liner junction device 124 in a downhole direction in the main wellbore. A downhole end of the second leg 136 of the liner junction device 124 is sealingly coupled to a lower lateral tieback and seal assembly 164 disposed in the main wellbore 116 downhole of the junction 132. In certain instances the second leg 136 stabs into and seals in a polished bore receptacle 130 in the lower lateral tieback and seal assembly 164. A polished bore receptacle is a type of sealing interface having a smooth surface finished receptacle bore that receives a male stinger under relatively close tolerances (in contrast to the large tolerances sealed by packer seals). The male stinger carries one or more o-rings, metal seals, other type of precision fit seals to seal on the bore. The first leg 138 of the liner junction device 124 extends from the body 134 of the liner junction device 124 into the lateral injection wellbore 112 and is coupled to the injection lateral liner 118, for example, at a swivel joint 146. The lateral tieback and seal assembly 164 can engage the casing 158 of the main wellbore 116 with a latch assembly 165. One example of a latch assembly that can be used in the systems described herein includes a LatchRite® assembly commercially available from Halliburton Energy Services, Inc. The uphole end of the lower lateral tieback and seal assembly 164 includes a bore deflector 140, adapted to deflect the injection lateral liner 118 into the lateral injection wellbore 112 when the injection lateral liner 118 and liner junction device 124 are run-in through the main wellbore 116. The first leg 138 of the liner junction device 124 can be configured to flex to allow the second leg and injection lateral liner 118 to be oriented toward downhole, substantially parallel to the second leg 136, when the liner junction device 124, and injection lateral liner 118 are run-in through the main wellbore 116. Examples of junction devices that can be used in the described configuration include the FlexRite® junction produced by Halliburton Energy Services, Inc., the RapidExclude™ junction produced by Schlumberger, and/or other junctions. In certain instances, the FlexRite® junction used in this context can provide a Technical Advancement of Multilaterals (TAML) level 5 seal. In other words, the junction is sealed or substantially sealed against flow of gas and/or liquid, so that all or substantially all flow from the production lateral wellbore 114 and flow to the injection lateral wellbore 112 is retained within the liner junction device 124.

In the illustrated embodiment, a swivel 146 connects the liner junction device 124 to the injection lateral liner 118, and allows the injection lateral liner 118 to rotate (i.e., swivel) around its central axis. The liner junction device 124 can be configured with a seal 126 (e.g., a swellable packer, an inflatable packer, and/or other seal) to seal against flow from the lateral injection wellbore 112 into the main wellbore 116 in the annulus between the injection lateral liner 118 and a wall of the lateral injection wellbore 112. In the illustrated embodiment, the swivel 146 supports seal 126 on an outer surface of the swivel 146. One or more additional seals may be provided. Additionally or alternatively, a seal in the annulus between the injection lateral liner 118 and the wall of the lateral injection wellbore 112 may be formed by depositing cement in the annulus. In certain instances, the cement may be a thermally resistant cement such as STEAMSEAL® cement available from Halliburton Energy Services, Inc. An expansion joint 148 can also be provided at the interface with the injection lateral liner 118. Expansion joints can be used compensate for axial expansion and contraction of liner 118, for example, due to thermal effects. Although only one expansion joint 148 is shown, in some instances multiple expansion joints can be placed between the swivel 146 and the liner 118 and/or along the length of the liner 118 (e.g., between joints of the liner 118 or elsewhere). The liner can include one or more joints of permeable tubing 154, such as apertured tubing, sand screens and/or other types of permeable tubing, to allow flow of heated injection fluid from the interior of the liner 118 into the subterranean zone 110. In certain instances, one or more flow distribution valves 152 can be included in the liner 118 to distribute and/or control flow from the interior of the liner 118 into the subterranean zone 110. Some examples of flow distribution valves 152 are described in U.S. patent application Ser. No. 12/039,206, entitled "Phase-Controlled Well Flow Control and Associated Methods," U.S. patent application Ser. No. 12/123,682, entitled "Flow Control in a Wellbore," And U.S. Pat. No. 7,032,675, entitled "Thermally Controlled Valves and Methods of Using the Same in a Wellbore."

A treatment fluid injection string 156 extends from wellhead 142 down main wellbore 116, through the first leg 138 of the liner junction device 124, and terminates in the liner 118. In certain instances, the treatment fluid injection string 156 terminates in a blind end or an open end. A portion of the treatment fluid injection string 156 has apertures 150 along its length coinciding with the portion that will reside in the liner 118. In certain instances, the apertures 150 can be of selected size and spacing to substantially evenly distribute heated injection fluid supplied through the injection string 156 along the length of the injection string 156. In other instances, the apertures 150 can be spaced and sized to provide a different distribution of heated fluid along the length of the injection string 156. In certain instances, the treatment fluid injection string 156 can terminate at or about the end of the first leg 138 of the liner junction device 124 or even within the liner junction device 124, and the portion that extends through the liner 118 omitted. All or a portion of the treatment fluid injection string 156 can be insulated. Insulating the treatment fluid injection string 156 through the liner junction device 124 helps to further thermally isolate the liner junction device from heat of heated treatment fluids flowing through the treatment fluid injection string 156. By providing the treatment fluid injection string 156 un-insulated or the portion of the treatment fluid injection string 156 in the main wellbore 116 un-insulated, heated treatment fluids flowing through the treatment fluid injection string 156 can contribute heat to produced or other fluids flowing up through the main wellbore 116.

In the illustrated embodiment, a seal centralizer 160 disposed in the main wellbore 116 helps set the positions of the treatment fluid injection string 156 and a production pump 162 (e.g., an inlet for a rod pump, an electric submersible pump, a progressive cavity pump, and/or other fluid lift system). Produced reservoir fluids that flow up from the production lateral 114, through the liner junction 124 can be produced to the surface with the production pump 162. Although shown terminating above the liner junction device 124, the string carrying the production pump 162 may, in certain instances, extend down to and sealingly connect with the liner junction device 124. For example, the string carrying the production pump 162 may be received in a polished bore receptacle at the upper seal assembly 128.

Seals 144 are positioned to provide a seal between an outer surface of the treatment fluid injection string 156 and an inner surface of the first leg 138. In other instances, the seals 144 can be positioned to seal against the interior of the lateral injection liner 118 or another component downhole from the junction liner device 124. The seals 144 seal against the return flow of treatment fluid (in liquid and/or gaseous form) along the annulus between the treatment fluid injection string 156 and the inner surface of the first leg 138 into the liner junction device 124. In certain instances, the seals 144 can include a polished bore receptacle, packer and/or other type of seal. Although three seals 144 are depicted, fewer or more seals can be provided.

A production liner 170 extends into the production lateral wellbore 114. The lower lateral tieback and seal assembly 164 includes lower lateral space out tubing 166 that extends downhole to the production lateral liner 170. The downhole end of the lower lateral space out tubing 166 is sealingly received in a lower seal assembly 168 disposed in the main wellbore 116. Some examples of lower seal assembly 168 include a packer, a packer liner hanger that engages the casing 158 of the main wellbore 116 (e.g., by slips, a profile and/or otherwise) to support the production lateral liner 170 and/or other seal assembly.

Additionally or alternatively, a seal in the annulus between the production lateral liner 170 and the wall of the lateral production wellbore 114 may be formed by depositing cement in the annulus. In certain instances, the cement may be a thermally resistant cement. Like the injection lateral liner 118, the production lateral liner 170 can include one or more joints of permeable tubing 154, one or more flow distribution valves 152 (e.g., to control/distribute inflow into the interior of the liner 170) and one or more expansion joints 148.

In forming well system 100, an entry bore 172 can be formed from terranean surface 120. A wellhead 142 may be disposed proximal to the surface 120. The main wellbore 116 can then be formed through entry bore 172 to extend downward to subterranean zone 110. The wellhead 142 may be coupled to a casing 158 that extends a substantial portion of the length of the main wellbore 116 from about the surface 120 towards the subterranean zone 110 (e.g., the subterranean interval being treated). In some instances, the casing 158 may terminate at or above the subterranean zone 110 leaving the wellbore 114 un-cased through the subterranean zone 110 (i.e., open hole). In other instances, the casing 158 may extend through the subterranean zone and may include one or more pre-milled windows formed prior to installation of the casing 158 to allow for easier formation of lateral wellbore 114. Some, all or none of the casing 158 may be affixed to the adjacent ground material with a cement jacket or the like. In certain instances, the cement may include thermally resistant cement. The casing 158 can include a portion of the latch assembly 165 (e.g., the receiving profile that the remainder of the latch assembly 165 engages) downhole of the desired kickoff location for the lateral injection wellbore 112. The casing 158 can also include a portion of the seal assembly 168 (e.g., the receiving profile that the remainder of the seal assembly 168 engages) about the downhole end of casing 158. During construction, temperature sensors can be used to monitor temperature levels outside the main wellbore casing.

The production liner 170 is installed in production lateral wellbore 114, and the seal assembly 168 set. If flow distribution valves 152 are provided, they can either be concentrically deployed inside the production liner 170 using a separate tubular or can be deployed with the liner 170. Blank pipe and/or additional packers can be included in the production liner 170 to compartmentalize the flow through distribution valves 152.

A whipstock is then installed in the main bore 116 and, in certain instances, may be supported by the latch assembly 165. The whipstock is used when milling a window through the casing 158 of the main wellbore 116 to provide access for drilling the injection lateral wellbore 112. As mentioned above, pre-milled window joints can be used in the construction of the main wellbore. The pre-milled window joints can provide uniformity of the geometry of the resulting window, and also can limit the amount of debris created during formation of the latter wellbores. The lateral injection wellbore 112 is then drilled extending from the main wellbore 116 through the window into the subterranean zone 110.

After the whipstock is withdrawn, the lower lateral tieback and seal assembly 164 is installed in the main wellbore 116 and supported by the latch assembly 165. As mentioned above, the lower lateral tieback and seal assembly 164 includes a bore deflector 140. The liner junction device 124 is then inserted down the main wellbore 116 with the injection lateral liner 118 attached to the first leg 138 of the liner junction device 124. Contact with bore deflector 140 of the lower lateral tieback and seal assembly 164 directs the injection lateral liner 118 into the lateral injection wellbore 112. The first leg 138 of the liner junction device 124 follows the injection liner 118 into the lateral injection bore 112 as the second leg 136 of the liner junction device 124 sealingly stabs into the lower lateral tieback and seal assembly 164. With the liner junction device 124 in place, seal assembly 128 is set.

The junction liner device 124 is isolated from the annulus between the lateral injection liner 118 and the lateral injection bore 112 (and thus from heated treatment fluid when the well system is in operation) using seal 126 and/or by cementing the annulus. In certain instances, cementing can be facilitated by providing a inflatable packer assembly to define a flow stop onto which cement can be loaded and by providing a selectably openable/closeable port in the first leg 138. If provided, flow distribution valves 152 can either be concentrically deployed inside the lateral injection liner 118 using a separate tubular or can be deployed with the liner 118. Blank pipe and/or packers can additionally included in the injection liner 118 to compartmentalize the flow through distribution valves 152.

The seal centralizer 160 can be run into and set in the main wellbore 116 on the treatment fluid injection string 156 and/or the production pump string 162. The treatment fluid injection string 156 is run into the main wellbore 116, through the junction liner device 124 and into the lateral injection liner 118. The treatment fluid injection string 156 seals at seals 144, isolating the junction liner device 124 against flow from the injection lateral liner 118 through the first leg 138 (and thus from heated treatment fluid when the well system is in operation).

In the illustrated embodiment, the main wellbore 116 has a substantially vertical entry portion extending from the terranean surface 120 that then deviates to form a slanted portion from which substantially horizontal lateral wellbores extend into to the subterranean zone 110. However, the systems and methods described herein can also be used with other wellbore configurations (e.g., slanted wellbores, horizontal wellbores, and other configurations).

In some cases, a downhole fluid lift system, operable to lift fluids towards the terranean surface 120, is at least partially disposed in the wellbore 114 and may be integrated into, coupled to or otherwise associated with a production tubing string (not shown). To accomplish this process of combining artificial lift systems with downhole fluid heaters, a downhole cooling system can be deployed for cooling the artificial lift system and other components of a completion system. Such systems are discussed in more detail, for example, in U.S. Pat. App. Pub. No. 2008/0083536, entitled "Producing Resources Using Steam Injection." Other downhole fluid lift systems and methods can also be used.

Figure 3:
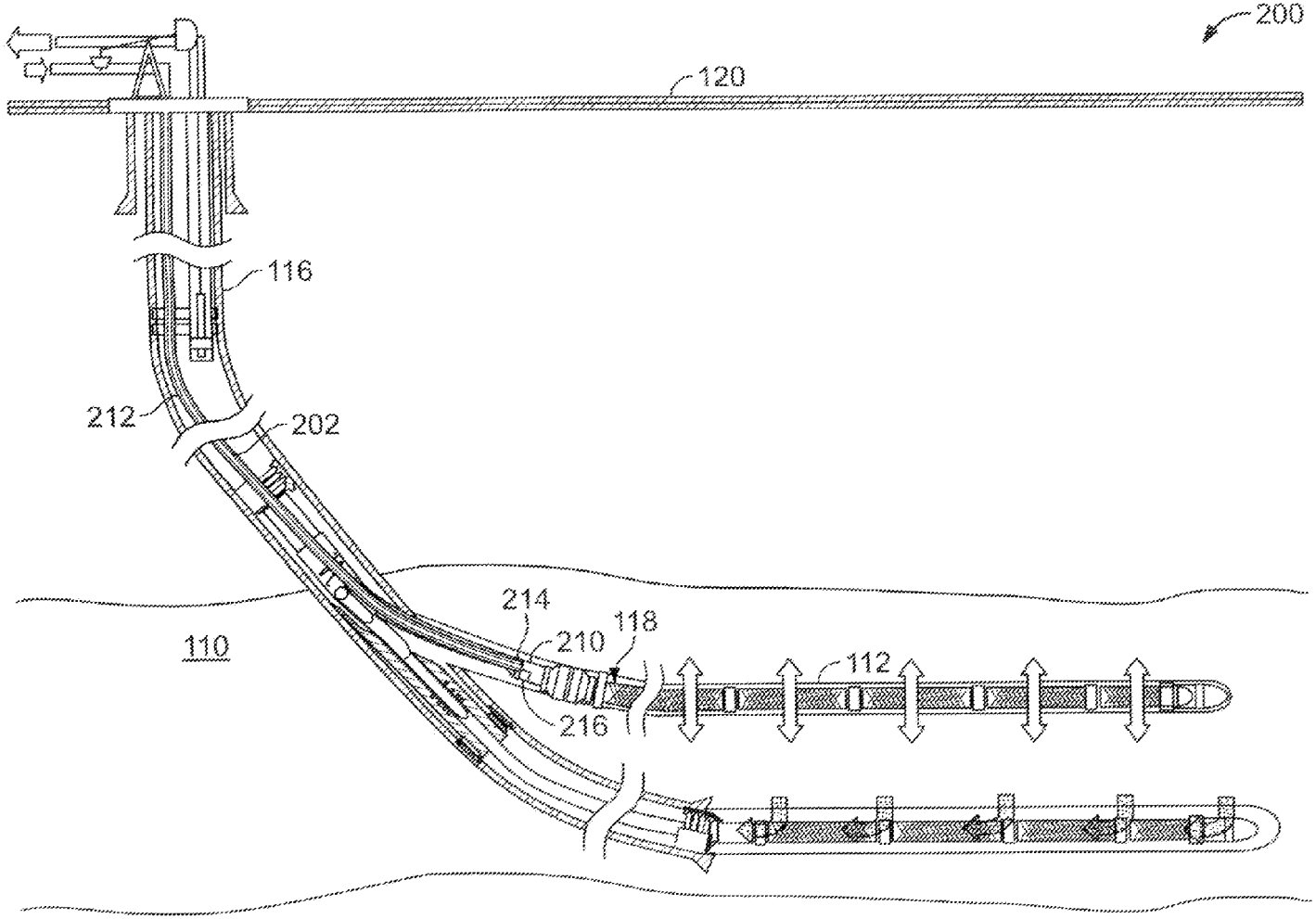
FIG. 3 is a schematic view of an embodiment of a system for treating a subterranean zone.

Referring to FIG. 3, another exemplary embodiment of a subterranean zone treatment system 200 includes a downhole fluid heater 210 (e.g., a steam generator). Although generally similar to that discussed above with reference to FIG. 1, the addition of a downhole fluid heater 210 disposed in the lateral injection wellbore 112 as part of the treatment fluid injection string 202 enables generating heated fluid proximate the subterranean zone 110 in the lateral injection wellbore 112. Although described below as residing in the lateral injection wellbore 112, a downhole fluid heater 210 can alternately, or additionally, be provided elsewhere in the system 200, such as in the junction liner device 124, in the main wellbore 116 and/or in another location. As used herein, "downhole" devices are devices that are adapted to be located and operate in a wellbore.

The downhole fluid heater 210 is received in the interior of the first leg 138 of the junction liner device 124 and sealed by seal 216. In certain instances, seal 216 is a polished bore receptacle or packer in the interior of the first leg 138 that interfaces with the exterior of the downhole fluid heater 210 or another portion of the treatment fluid injection string 202. The treatment fluid injection string terminates at or about the outlet of the downhole fluid heater 210 in the lateral injection wellbore 112. The downhole fluid heater 210 includes inlets 214 to receive the treatment fluid, and in the case of combustion based downhole fluid heaters, other fluids (e.g., oxidant and fuel) and may have one of a number of configurations to deliver heated treatment fluids to the subterranean zone 110. U.S. Patent Pub. No. 2007/0039736, entitled "Communicating Fluids with a Heated-Fluid Generation System" discloses one example of a downhole fluid heater 210 received in a polished bore receptacle.

In this embodiment, the downhole fluid heater is a combustion based steam generator 210. Supply lines 212 convey, for example, fuel, treatment fluid, and oxidant to the downhole fluid heater 210 from surface sources (not shown). Various implementations of supply lines 212 are possible. For example, supply lines 212 can be integral parts of the production tubing string, can be attached to the production tubing string, or can be separate lines run through main wellbore 116. Although depicted as concentrically arranged within another, one or more of supply lines 212 could be separate, parallel flow lines and/or fewer or more than three supply lines could be provided. One exemplary tube system for use in delivery of fluids to a downhole fluid heater includes concentric tubes defining at least two annular passages that cooperate with the interior bore of a tube to communicate air, fuel and treatment fluid to the downhole heated fluid generator. For example, U.S. Patent Pub. No. 2007/0039736, entitled "Communicating Fluids with a Heated-Fluid Generation System" discloses one embodiment of a downhole fluid heater having concentric supply lines.

Supply lines 212 carry fluids from the surface 120 to corresponding inlets 214 of the downhole fluid heater 210. For example, in some embodiments, the supply lines 212 include a treatment fluid supply line, an oxidant supply line, and a fuel supply line. In some embodiments, the treatment fluid supply line is used to carry water to the downhole fluid heater 210. The treatment fluid supply line can be used to carry other fluids (e.g., synthetic chemical solvents or other treatment fluid) instead of or in addition to water. In this embodiment, fuel, oxidant, and water are pumped at high pressure from the surface to the downhole fluid heater 210.

In some embodiments, the supply lines 212 have a downhole control valve(s) (not shown). In some situations (e.g., if the casing system in the well fails), it is desirable to rapidly discontinue the flow of fuel, oxidant and/or treatment fluid to the downhole fluid heater 210. A valve in the supply lines 212 deep in the well, for example in the proximity of the fluid heater 210, can prevent residual fuel and/or oxidant in the supply lines 212 from flowing to the fluid heater 210, preventing further combustion/heat generation, and can limit (e.g., prevent) discharge of the reactants in the downhole supply lines 212 into the wellbore.

The system 200 is installed in a substantially similar fashion as described for the installation of the system 100. For example, the treatment fluid injection string 202 is run in through the main wellbore 116, liner junction device 124 and into the lateral injection wellbore 112 and the downhole fluid heater 210 and/or the treatment fluid injection string 202 is sealed to prevent flow through the annulus between the treatment fluid injection string 202 and the first leg 138 of the liner junction device 124.

Figure 4:
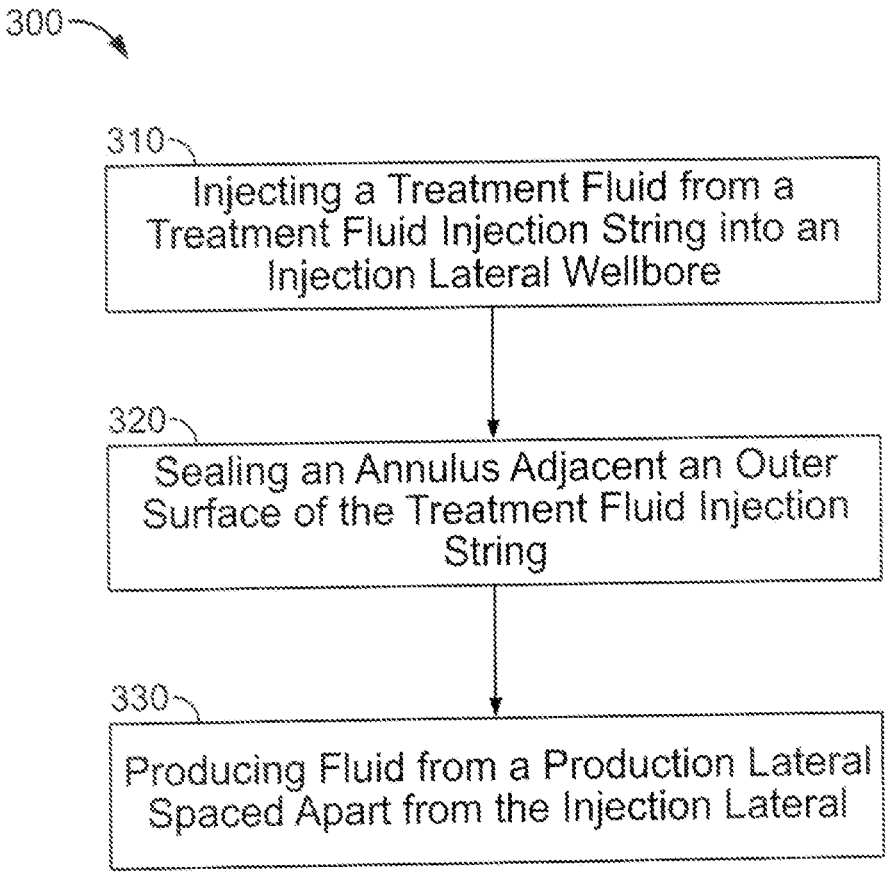
FIG. 4 a flow chart of a method for operating a system for treating a subterranean zone.

Referring now to FIG. 4, in operation, systems 100 and 200 can be used to produce fluids using a method 300 that includes injecting a heated treatment fluid from the treatment fluid injection string 156, 202 into the lateral injection wellbore 112. As described above, the treatment fluid injection string 156, 202 extends from the liner junction device 124 into the lateral injection bore 112 and terminates in the lateral injection wellbore 112 (step 310). The annulus adjacent an outer surface of the treatment fluid injection string 156, 202 is sealed against flow to the liner junction 124 by, for example, the seal 126 (step 320). The annulus between the treatment fluid injection liner 118 and lateral injection wellbore 112 has also been sealed. Therefore, all or substantially all of the heated treatment fluid is provided into the subterranean zone 110 and prevented from flowing back into or onto the liner junction device 124 and associated components. With heated treatment fluid injected into the subterranean zone 110, the reservoir fluids are mobilized. Reservoir fluids are then produced from the production lateral wellbore 114 (step 330). As shown in FIGS. 1 and 3, the production lateral wellbore 114 is vertically spaced apart from the lateral injection wellbore 112, so that reservoir fluids tend to migrate downward under the force of gravity toward the production lateral wellbore 114 (i.e., consistent with SAGD type recovery). In other types of steam flood configurations (i.e., not SAGD) the production lateral wellbore 114 and lateral injection wellbore 112 may or may not be vertically spaced apart. For example, the production lateral wellbore 114 and lateral injection wellbore 112 may be in the same or substantially same horizontal plane. In certain instances, the production lateral wellbore 114 may be spaced horizontally apart from the lateral injection wellbore 112 or may be in the same or substantially same vertical plane.

In some cases, sealing the annulus adjacent an outer surface of the treatment fluid injection string includes sealing an annulus between the treatment fluid injection string and the liner junction device. In some cases, sealing the annulus adjacent an outer surface of the treatment fluid injection string includes disposing cement in the lateral injection wellbore.

In some cases, the treatment fluid is heated using a downhole fluid heater 210 (e.g., a downhole fluid heater disposed in the lateral injection wellbore 112). In some cases, treatment fluid is heated at the surface 120 and heated treatment fluid is pumped downhole through the liner junction 124.

A number of embodiments of the invention have been described. Nevertheless, it will be understood that various modifications may be made without departing from the spirit and scope of the invention. For example, although FIGS. 1 and 3 show well systems with the heated fluid injection string in the context of a dedicated injection wellbore (e.g., where the wellbore is operated as an injection well to provide heated treatment fluid injection for other, production wells), for example, in a steam flood or a steam assisted gravity drainage (SAGD) context, the concepts described herein are also applicable to cyclical heated fluid injection process (e.g., "huff-n-puff" where the wellbore is cyclically operated to inject heated treatment fluid for a period time, and then reconfigured for use as a production wellbore), as well as other heated fluid injection processes. Also, the well systems described herein are applicable to injection of other types of treatment fluid that may or may not be heated. For example, treatment fluids such as acid, fracturing fluid (e.g. with proppant), cement, gravel (e.g., for gravel packing) and/of other types of treatment fluids could be injected via a string similarly located and sealed as the treatment fluid injection string 156. Accordingly, other embodiments are within the scope of the following claims.

What is claimed is:

1. A well system comprising:

a main wellbore extending from a terranean surface toward a subterranean zone;

a first lateral wellbore extending from the main wellbore into the subterranean zone;

a second lateral wellbore extending from the main wellbore into the subterranean zone, the second lateral wellbore substantially parallel to the first lateral wellbore;

a liner junction device in the main wellbore having a first leg extending into the first lateral wellbore and a second leg extending downhole in the main wellbore;

a heated treatment fluid injection string that extends from in the main wellbore through the liner junction device and into the first lateral wellbore and terminates in the first lateral wellbore; and a seal in the first lateral wellbore that seals against flow toward the main wellbore in an annulus adjacent an outer surface of the heated treatment fluid injection string.

2. The well system of claim 1, further comprising a downhole fluid heater in the heated treatment fluid injection string.

3. The well system of claim 2, wherein the downhole fluid heater is disposed in the first lateral wellbore.

4. The well system of claim 2, wherein the seal seals between the downhole fluid heater and the first leg of the liner junction device.

5. The well system of claim 4, wherein the seal comprises a polished bore receptacle.

6. The well system of claim 1, wherein the heated treatment fluid injection string is coupled to a source of heated treatment fluid at the terranean surface.

7. The well system of claim 1, wherein the seal seals between the heated treatment fluid injection string and the first leg of the liner junction device.

8. The well system of claim 7, wherein the seal comprises a polished bore receptacle.

9. The well system of claim 1, further comprising a second seal in the first lateral wellbore that seals against flow toward the main wellbore in an annulus adjacent the second leg and the first lateral wellbore.

10. The well system of claim 9, wherein the second seal comprises a deposit of cement.

11. The well system of claim 1, comprising a seal in the main wellbore that seals against axial flow in an annulus adjacent an outer surface of the liner junction device.

12. The well system of claim 1, further comprising a liner residing in the first lateral wellbore and coupled to the first leg of the liner junction device, the liner comprising one or more joints of permeable tubing to allow flow of heated injection fluid from an interior of the liner into the subterranean zone.

13. The well system of claim 12, wherein a portion of the heated treatment fluid injection string has apertures along a length coinciding with the portion residing in the liner, the apertures being of a selected size and spacing to distribute the heated injection fluid supplied through the heated treatment fluid injection string along a length of the liner.

14. The well system of claim 1, further comprising a liner residing in the first lateral wellbore and being coupled to the first leg of the liner junction device.

15. The well system of claim 14, further comprising a swivel connecting the liner junction device to the liner that allows the liner to rotate around its central axis.

16. The well system of claim 14, wherein the first leg flexes to orient the first leg with the liner.

17. The well system of claim 1, wherein:

the liner junction device comprises a body that extends from an upper seal assembly that is disposed in the main wellbore uphole of the liner junction device and engaged with a casing of the main wellbore to support the liner junction device, the first leg extends from the body into the first lateral wellbore, and the second leg extends from the body in a downhole direction in the main wellbore.

18. The well system of claim 1, wherein the second leg is sealingly coupled to a lower lateral tieback and seal assembly disposed in the main wellbore downhole of the liner junction device.

19. A well system comprising:

a multilateral wellbore system having a main wellbore and a plurality of substantially parallel lateral wellbores that extend from the main wellbore;

a liner junction device residing in the main wellbore;

a liner residing in one of the lateral wellbores and coupled to the liner junction device;

a heated fluid injection string extending from in the main wellbore, through the liner junction device, and terminating in the liner; and seals sealing against flow to the main wellbore from between the liner and the lateral wellbore and from between the heated fluid injection string and the liner.

20. The well system of claim 19, wherein the seal sealing against flow to the main wellbore from between the heated fluid injection string and the liner comprises a polished bore receptacle.

21. The well system of claim 20, wherein the polished bore receptacle resides in the liner junction device.

22. The well system of claim 19, wherein the seal sealing against flow to the main wellbore from between the liner and the lateral wellbore comprises a deposit of cement in the lateral wellbore.

23. The well system of claim 19, wherein the heated fluid injection string comprises a heated fluid generator.

24. The well system of claim 19, wherein the liner junction device comprises a leg extending from the main wellbore into the one of the lateral wellbores and being coupled to the liner at a swivel joint.

25. A method comprising:

injecting a heated treatment fluid into a lateral injection wellbore extending from a main wellbore with a heated treatment fluid injection string that extends from the main wellbore, through a liner junction device residing in the main wellbore, into the lateral injection wellbore, and terminates in a liner residing in the lateral injection wellbore, the liner coupled to a leg of the liner junction device that extends from the main wellbore into the lateral injection wellbore;

sealing an annulus adjacent an outer surface of the heated treatment fluid injection string against flow toward the main wellbore; and producing fluid from a production lateral wellbore extending from the main wellbore and spaced apart from the lateral injection wellbore.

26. The method of claim 25, further comprising heating the heated treatment fluid using a downhole fluid heater.

27. The method of claim 25, wherein sealing the annulus adjacent an outer surface of the heated treatment fluid injection string comprises sealing an annulus between the heated treatment fluid injection string and an adjacent tubular.

28. The method of claim 25, wherein sealing the annulus adjacent an outer surface of the heated treatment fluid injection string comprises disposing cement in the lateral injection wellbore.

29. The method of claim 25, wherein injecting the heated treatment fluid into an lateral injection wellbore comprises injecting the heated treatment fluid from a terranean surface.

30. The method of claim 25, further comprising sealing the main wellbore above the lateral injection wellbore and below a wellhead.

31. The method of claim 25, wherein the production lateral wellbore is substantially parallel to the lateral injection wellbore.

* * * * *